US005715959A

United States Patent [19]

Pfefferkorn et al.

[11] Patent Number: 5,715,959

[45] Date of Patent: Feb. 10, 1998

[54] CLOSURE CAP WITH ANTI-TAMPER RING

[75] Inventors: Georg Pfefferkorn; Michael Kirchgessner, both of Egringen; Udo Bösl, Eimoldingen, all of Germany

[73] Assignee: Crown Cork AG, Reinach, Switzerland

[21] Appl. No.: 591,630

[22] PCT Filed: May 26, 1995

[86] PCT No.: PCT/CH95/00120

§ 371 Date: May 8, 1996

§ 102(e) Date: May 8, 1996

[87] PCT Pub. No.: WO96/00171

PCT Pub. Date: Jan. 4, 1996

[30] Foreign Application Priority Data

Jun. 27, 1994 [CH] Switzerland ..... 2035/94

[51] Int. Cl.[6] ..... B65D 41/34

[52] U.S. Cl. ..... 215/252; 215/256

[58] Field of Search ..... 215/252, 256, 215/250; 200/276

[56] References Cited

U.S. PATENT DOCUMENTS

| | | | |
|---|---|---|---|
| 4,664,278 | 5/1987 | Barriae | 215/252 |
| 4,805,791 | 2/1989 | Begley | 215/252 |
| 4,930,647 | 6/1990 | Dutt et al. | 215/252 |
| 5,573,128 | 11/1996 | Tsujiguchi et al. | 215/252 |

FOREIGN PATENT DOCUMENTS

| | | |
|---|---|---|
| 0004500 | 10/1979 | European Pat. Off. . |
| 2530699 | 1/1977 | Germany . |
| 8509960 | 6/1985 | Germany . |
| 2199571 | 7/1988 | United Kingdom . |

*Primary Examiner*—Joseph M. Moy

*Attorney, Agent, or Firm*—Woodcock Washburn Kurtz Mackiewicz & Norris LLP

[57] ABSTRACT

Closure caps with anti-tamper strips (3) are used to visually display initial opening of a container to the public. The possibility of opening such a container without evidence should be prevented as far as possible. The possibility of stretching the anti-tamper strip (3), in order to then manipulate it past the bead on the container mouth, is here countered by an additional security ring (7). This security ring (7) is arranged coaxially to the actual anti-tamper ring (3). It is connected to the anti-tamper ring and mainly surrounds the lower area (5) of said anti-tamper ring. Access to the actual anti-tamper ring is considerably hindered as a result. In a preferred embodiment, the security ring possesses weakened zones (10) that break during manipulation, so that the interference will be visibly displayed to the outside.

9 Claims, 3 Drawing Sheets

CLOSURE CAP WITH ANTI-TAMPER RING

Figure 1:
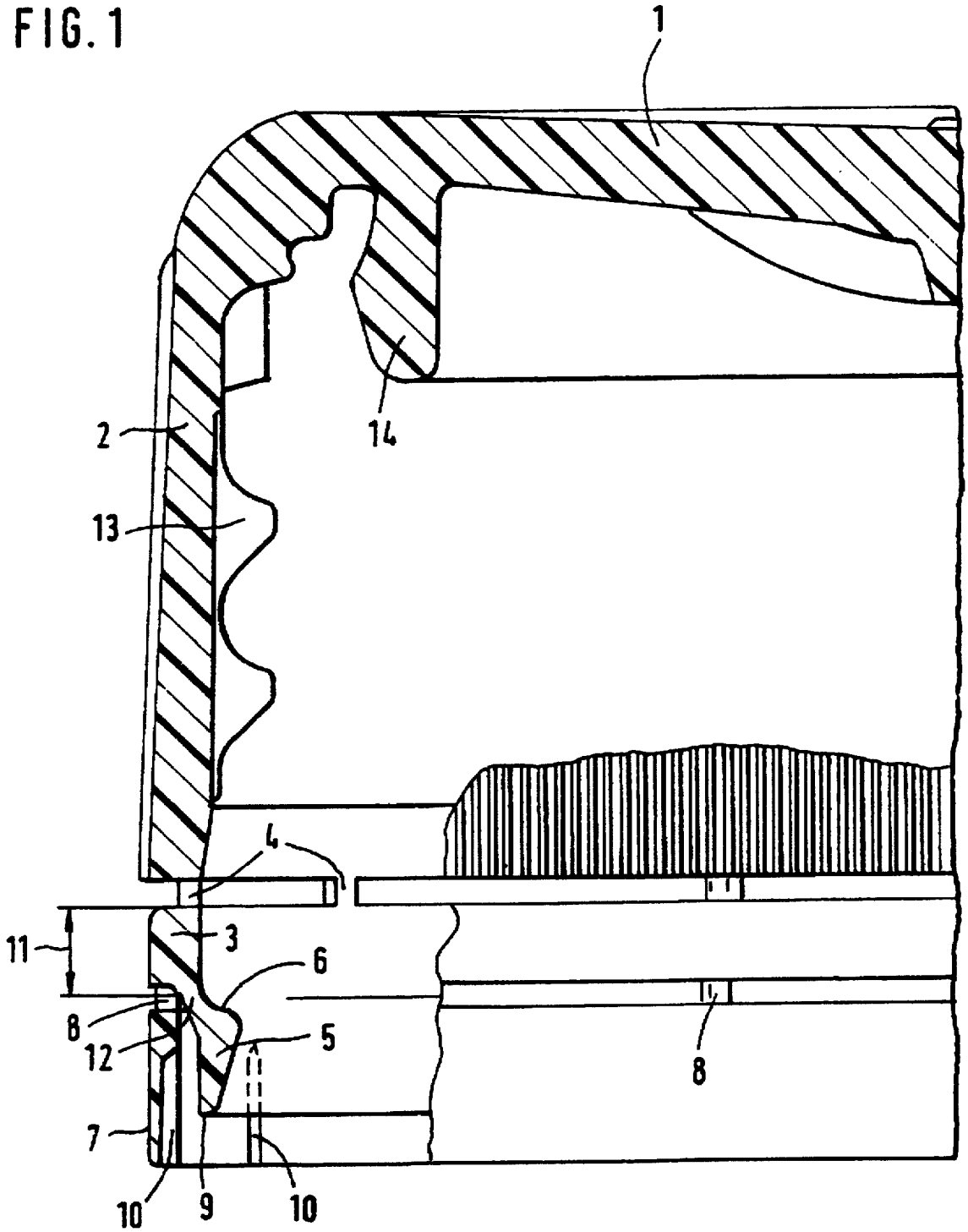

The invention concerns a plastic closure cap with an anti-tamper ring according to the preamble to claim 1. Such closure caps are preferably formed as screw caps and are used to close container mouths with an outside thread. With the closure cap in position, the anti-tamper ring will engage beneath a mostly annular protrusion on the container mouth, and this will lead to the anti-tamper ring tearing away on initial opening of the container. Anti-tamper closures of this type are, for example, used for the assured closure of beverage bottles. The condition of the anti-tamper ring will permit consumers to recognise if the container has already been opened.

Particularly in the beverage industry, but also in the packaging of pharmaceutical products, for example, great value is placed on the security and reliability of such anti-tamper closures. Through suitable means, any manipulation of the anti-tamper strip that could enable unnoticed opening of the closure must therefore be hindered and if possible prevented.

A closure cap of the aforementioned type and possessing an additional protecting ring is disclosed in U.S. Pat. No. 4,147,268. At its upper end, this protecting ring is firmly connected with the cap wall, and extends downwards from the cap wall to the upper end of the anti-tamper ring, and thus protects the bridge-pieces connecting the anti-tamper ring with the cap wall from manipulation. Nevertheless, the anti-tamper ring, and in particular its lower portion engaging beneath the container mouth, is still directly accessible from outside. Attempts at deliberately and surreptitiously opening the container through manipulating the anti-tamper ring are not hindered by the protecting ring. Attempts at stretching, for example, are conceivable, with the intention of opening the container by prying the anti-tamper ring over the protrusion on the container mouth without subjecting it to damage.

It is therefore a purpose of the invention to avoid the known disadvantages, and create a plastic closure cap, the anti-tamper ring of which is better protected from unnoticed manipulation. According to the invention, this purpose is fulfilled by a closure cap with the features of claim 1.

The closure cap comprises a cap base and a usually cylindrical cap wall abutting said cap base. It is predominantly formed as a screw cap, the cap wall possessing a screw thread on its inside, said screw thread being engaged with a corresponding outside thread on the container mouth on closing the container. Nevertheless, other closure systems such as bayonette or snap closures could be used. On its lower edge oriented away from the cap base, the cap wall is connected with a frangibly connected anti-tamper ring. This anti-tamper ring engages beneath a mostly annular protrusion on the container neck when the container is closed. The frangible connection between the anti-tamper ring and the cap-wall as a rule comprises individual frangible bridge-pieces distributed around the circumference or, for example, a frangible connection with a wall section with a reduced wall thickness, for example thinned to a film, that will tear away on initial opening of the closure. Apart from that, the anti-tamper ring can be firmly connected with the cap wall by means of one or more wide bridge-pieces and at the same time possess a frangible point with reduced anti-tamper ring cross section on its circumference. These types of anti-tamper strips are known in a plurality of embodiments, they remain connected with the cap wall by means of the wider connecting bridge-pieces even after opening of the container, and are therefore preferably used to close returnable containers (for example deposit bottles). These types of anti-tamper ring already offer a certain protection against unauthorised manipulation, but the risk still exists with attempts at stretching that the frangible point of the anti-tamper ring will tear, and the interference will be displayed in this way. Thus, in particular it is anti-tamper rings that are connected with the cap wall only by means of frangible bridge-pieces, and which therefore remain on the container neck on opening, whose security can be increased by the invention in question.

In order to hinder manipulation of the anti-tamper ring, an additional security ring is provided that is arranged to surround at least a portion of the said anti-tamper ring coaxially. The security ring is with that connected to the anti-tamper ring at its upper end, oriented towards the cap wall. The security ring covers at least a portion of the anti-tamper ring so that said anti-tamper ring is no longer accessible from the outside. Particularly good protection is attained if the free end of the anti-tamper ring lies within the security ring. The free end is the lower end of the anti-tamper ring, not connected with the cap wall. If this free end lies within the security ring, this will mean that the security ring will extend downwards beyond the anti-tamper ring or that the lower edge of the anti-tamper ring and the security ring will at least lie at the same height. The use of a security ring that extends downwards at least 0.5 mm beyond the free end of the anti-tamper ring is particularly preferred. Thus, the free end of the anti-tamper ring, which represents the main vulnerable point on the anti-tamper ring for attempts at stretching, is particularly effectively protected against external interference.

Preferably, a mechanical anti-tamper strip is used that possesses on its inside at least one retaining element with a locking surface, said locking surface engaging beneath a protrusion on the container mouth when the container is closed. Attempts at stretching the anti-tamper ring, which theoretically permit the retaining element to be displaced radially outwards, should be hindered by the additional security ring. But even if the security ring is stretched, this will lead to a gentle expansion of the anti-tamper ring, since both rings are in fact connected. In order to ensure effective protection, the couple of the anti-tamper ring and the security ring must thus be kept to an absolute minimum. In particular, that area of the anti-tamper ring that engages beneath the annular protrusion on the container neck should, if possible, be uncoupled from the security ring. The security ring is thus preferably connected with the anti-tamper ring in an upper area of the anti-tamper ring, said area lying above the locking surface. The couple can be further reduced if the anti-tamper ring possesses a section between the aforementioned upper area and the locking surface of the retaining element in which the anti-tamper strip is thinner than in the upper area.

Further advantages will result if the outside diameter of the anti-tamper ring in its aforementioned upper area is greater than the inside diameter of the security ring. In this case the security ring is arranged beneath this area. This configuration is of advantage when the security ring is connected to the anti-tamper ring by means of frangible bridge-pieces. This preferred embodiment is more closely explained in the following. With a particularly preferred embodiment, the outside diameter in the upper area of the anti-tamper ring is equal to the outside diameter of the security ring. This permits the use of simple injection molding tools, results in an optically attractive design, and deformations to the security ring are more easily recognisable, since on inspection the outside surface of the upper anti-tamper strip area serves as a reference surface.

The strength of the connection between the anti-tamper ring and the security ring surrounding it will also influence the strength of mechanical couple between these two elements. A connection with less cross-sectional area will also cause a diminished mechanical couple. The security ring is therefore preferably connected to the anti-tamper ring by means of frangible bridge-pieces. This has the additional advantage that attempts at stretching the security ring can lead to breakage of these frangible bridge-pieces so that the manipulation becomes visible from outside.

It is, however, a fact that, in particular with attempts at stretching, the radial loading of the security ring is far greater than its axial loading. In order to ensure that a radial loading of the security ring will also lead to its destruction, and thus to an outwardly visible proof of manipulation, according to a further preferred embodiment, the security ring possesses on its circumference at least one frangible point with reduced security ring cross section. On radial loading, the security ring will break at this point. A plurality of frangible points can also be arranged to be distributed around the circumference of the security ring. The frangible point can, for example, be a vertical notch, preferably on the inside of the security ring. This has the advantage that the outside surface of the security ring in its original condition is smooth, also in the area of the frangible point, so that damage to this area will be immediately apparent.

Figure 2:
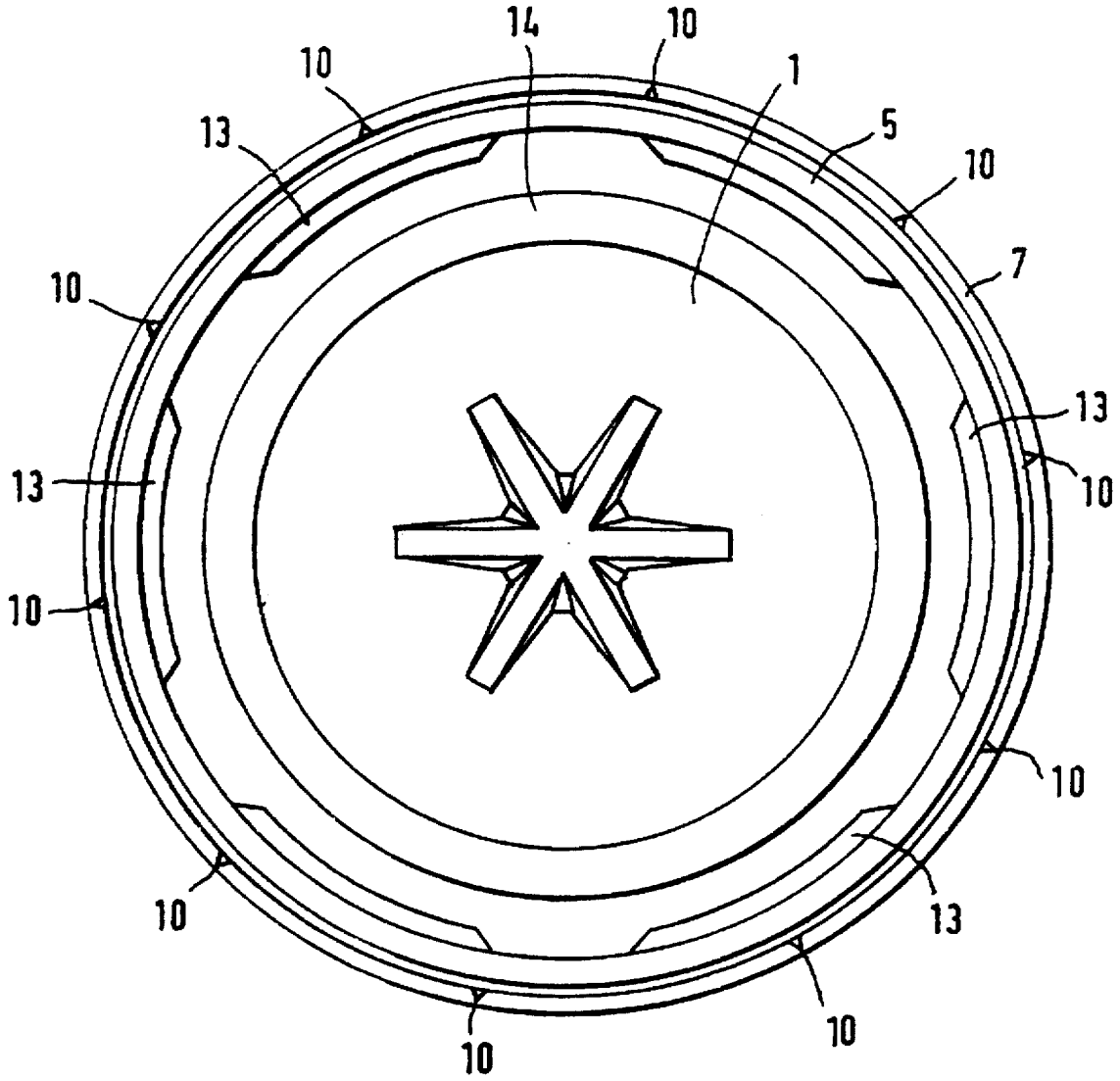
Figure 3:
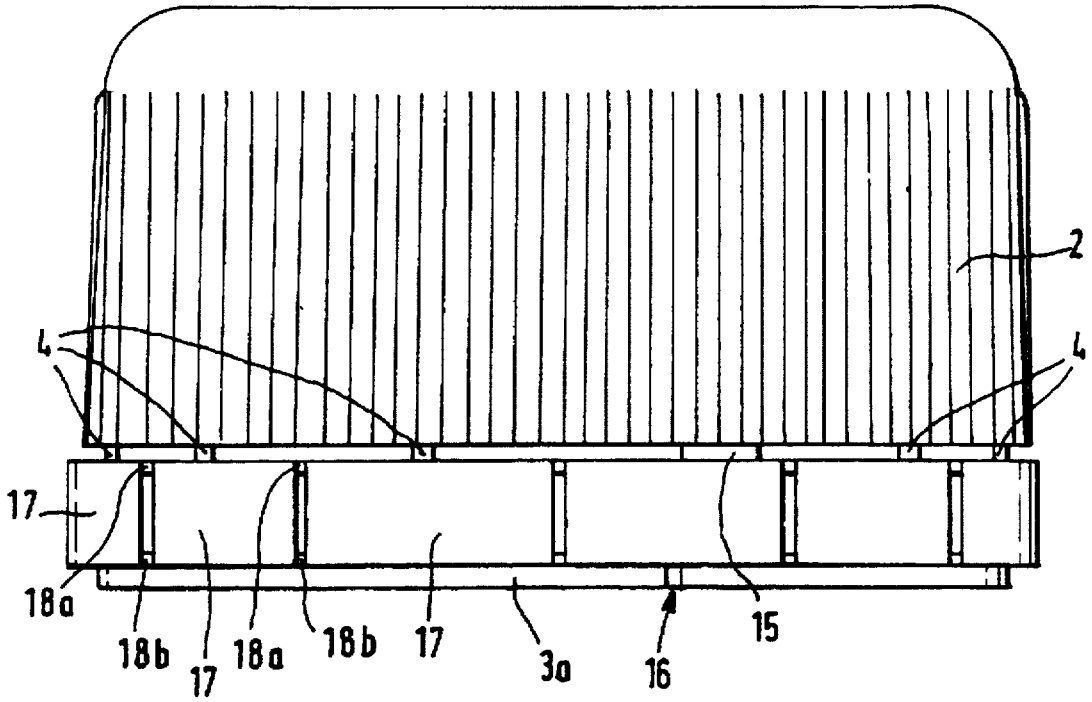

The invention is more closely described in the following, with the aid of the drawings: namely, FIG. 1 A cross-sectional drawing of a plastic closure with an anti-tamper ring partially surrounded by a security ring, FIG. 2 a view from below of the closure cap as shown in FIG. 1, FIG. 3 a side view of an alternative screw cap with anti-tamper ring and security ring, and FIG. 4 a cross-sectional drawing of the anti-tamper ring of the closure cap as shown in FIG. 3.

The closure cap shown in FIG. 1 comprises a cap base 1 and an abutting cylindrical cap wall 2. Said cap wall is connected with an anti-tamper ring 3 at its lower edge by means of frangible bridge-pieces 4. FIG. 1 is a partial cross section; the portion enclosed by an irregular line at lower right is an external view of the screw cap.

The lower portion of the anti-tamper ring 3 is surrounded by an additional security ring 7 arranged coaxially to said anti-tamper ring. The free end 9 of the anti-tamper ring lies within the security ring 7. Without removal of the security ring 7, access to the said free end from outside is only possible with difficulty. On its inside, the security ring possesses a plurality of notches 10, in the area of which the cross section of said security ring is reduced. Frangible points are thus concerned that will break open on radial loading of the security ring. Through the arrangement of notches 10 on the inside of the security ring 7, its outside surface will remain smooth. The breakage of a frangible point or notch will thus be immediately recognisable from outside.

The anti-tamper ring 3 has an upper area 11 in which its outside circumference is greater than the inside diameter of the security ring 7. This enables the connection of security ring 7 and anti-tamper ring 3 by means of frangible bridge-pieces 8 approximately parallel to the axis of the cap, said frangible bridge-pieces being easily visible from outside. These frangible bridge-pieces 8 are arranged to be distributed around the circumference, and connect the upper end of the security ring with the aforementioned upper area 11 of the anti-tamper ring.

On its inside surface, the anti-tamper ring 3 has a circumferential retaining element 5 with a locking surface 6, said locking surface engaging beneath an annular protrusion on the container mouth after fitting the closure. Between the locking surface 6 and the upper area 11, the anti-tamper ring has a section 12 with reduced wall thickness. This contributes to the reduction of the mechanical couple between the security ring 7 and the portion 5 engaging beneath the container mouth.

FIG. 2 shows the view of the screw cap shown in FIG. 1 from below. The security ring 7 surrounds the lower end 5 of the anti-tamper ring. Its vertical notches 10 are wedge shaped, the front tip of this wedge being separated from the outer surface of the security ring only by a thin skin of plastic. The frangible bridge-pieces 4 and 8 are not recognisable in this drawing. Conversely, the inside seal 14 extending from the cap base 1 has been drawn, and individual sections 13 of the cap thread can also be seen.

In FIG. 3, the side view of an alternative embodiment of the screw cap according to the invention is shown. Here, the security ring comprises individual elements shaped as annular sectors that are interconnected by frangible bridge-pieces 18. These frangible bridge-pieces 18 assume the function of the vertical notch 10 shown in FIG. 1. On radial loading of the security ring, they will break open and thus make attempts at manipulation visible from the outside.

Figure 4:
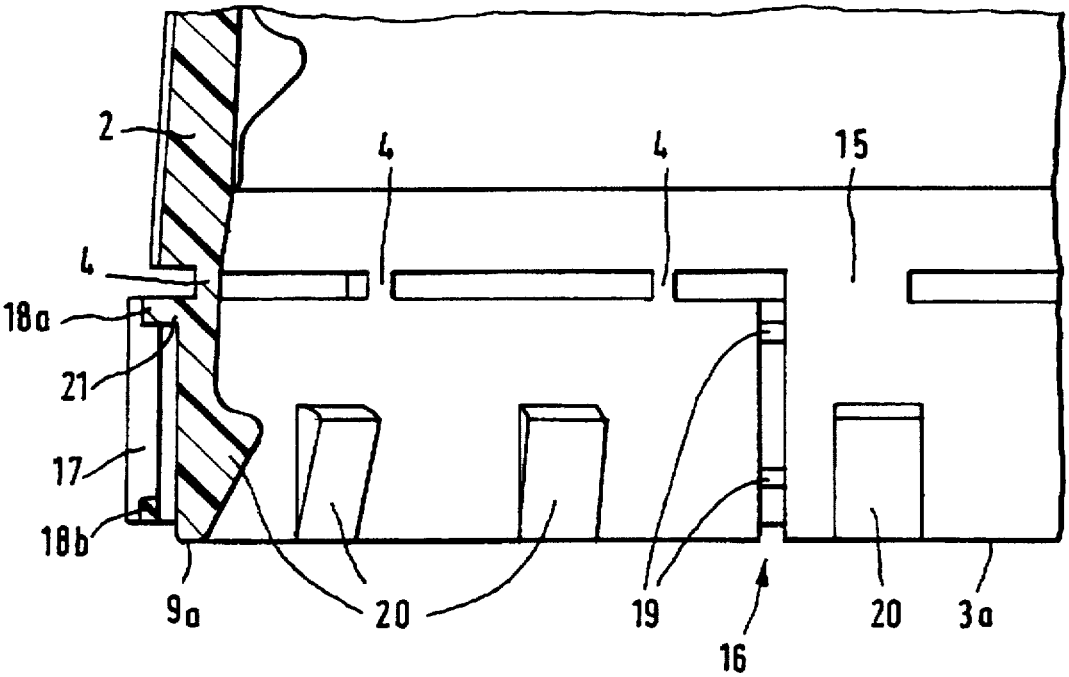

A detail of this screw cap is shown in FIG. 4 in cross section. Here, the connection between the security ring and the inside anti-tamper ring 3*a* can be seen, said connection comprising a plurality of frangible bridge-pieces 21 arranged to be distributed around the circumference. Each of these frangible bridge-pieces 21 connects one of the upper frangible bridge-pieces 18*a* of the security ring to the anti-tamper ring 3*a*.

Similar to that stated in conjunction with FIG. 1, the anti-tamper ring 3*a* is itself connected with the cap wall 2 of the closure by means of frangible bridge-pieces 4. Additionally, a firm connecting bridge-piece 15 is provided, to permanently connect the anti-tamper ring 3*a* to the cap wall 2 at one point on the circumference. Directly adjacent to the connecting element 15, the anti-tamper ring possesses a vertical frangible point 16 with reduced anti-tamper ring cross section. In this example, this comprises merely two thin bridge-pieces 19 that, on initial opening of the container, will tear so that the anti-tamper ring will be torn away from the container mouth and will remain connected with the cap wall 2 by means of the connecting element 15, also after opening of the container.

The retaining elements 20 engage beneath a bead on the container mouth when the closure is in position, and in their function correspond to the retaining elements 5 as shown in FIG. 1.

Inasmuch as the invention is subject to modifications and variations, the foregoing description and accompanying drawings should not be regarded as limiting the invention, which is defined by the following claims and various combinations thereof:

We claim:

1. Closure cap of a plastic material for closure of a container mouth, with a cap base (1) and an abutting, cylindrical cap wall (2), said cap wall being connected at its lower edge with a frangibly connected anti-tamper ring (3), said anti-tamper ring engaging beneath a protrusion on the container mouth when the container is closed, characterized by a security ring (7) that surrounds at least a portion of the said anti-tamper ring (7) and is arranged coaxially in relation to said anti-tamper ring, and is connected with said anti-tamper ring (3) at its end oriented towards the cap wall (2).

2. Closure cap according to claim 1, characterized in that the free end (9) of the anti-tamper ring (3) lies inside the security ring (7).

3. Closure cap according to claim 1, characterized in that the anti-tamper ring (3) possesses on its inside at least one retaining element (5) with a locking surface (6), said locking surface engaging beneath the protrusion on the container mouth when the container is closed, and that the security ring is connected with the anti-tamper strip in an area above the locking surface of said anti-tamper strip.

4. Closure cap according to claim 3, characterized in that the anti-tamper ring possesses a section between the upper area (11) and the locking surface (6) of the retaining element (5) in which the anti-tamper strip is thinner than in the upper area.

5. Closure cap according to claim 1, characterized in that the outside diameter of the anti-tamper ring (3) in its upper area (11) is greater than the inside diameter of the security ring, and that the security ring (7) is arranged beneath this area (11).

6. Closure cap according to claim 1, characterized in that the security ring (7) possesses on its circumference at least one frangible point (10) with reduced security ring cross section.

7. Closure cap according to claim 6, characterized in that the security ring (7) possesses a vertical notch (10) on its inner side in the area of the frangible point.

8. Closure cap according to claim 1, characterized in that the security ring (7) is connected to the anti-tamper ring (3) by means of frangible bridge-pieces (8) and/or a frangible position with a wall section with reduced wall thickness.

9. Closure cap according to claim 1, characterized in that the anti-tamper ring is connected with the cap wall only by means of frangible bridge-pieces, so that said anti-tamper ring will remain on the container neck on initial opening of the container.

* * * * *

UNITED STATES PATENT AND TRADEMARK OFFICE

CERTIFICATE OF CORRECTION

PATENT NO. : 5,715,959

DATED : February 10, 1998

INVENTOR(S) : Georg Pfefferkorn; Michael Kirchgessner; Udo Bösl

It is certified that error appears in the above-indentified patent and that said Letters Patent is hereby corrected as shown below:

Page 1, Column 1, [30] Foreign Application Priority Data, delete "2035/94" and insert --2035/94-9-- therefor.

Signed and Sealed this

Nineteenth Day of May, 1998

Bruce Lehman

*Attest:*

BRUCE LEHMAN

*Attesting Officer*

*Commissioner of Patents and Trademarks*